US006335519B1

(12) United States Patent
Cho et al.

(10) Patent No.: US 6,335,519 B1
(45) Date of Patent: Jan. 1, 2002

(54) MICROWAVE OVEN

(75) Inventors: Young-won Cho; Sung-ho Lee, both of Suwon; Tae-soo Kim, Seoul, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/756,121

(22) Filed: Jan. 9, 2001

(30) Foreign Application Priority Data

Jul. 27, 2000 (KR) ..... 00-43477

(51) Int. Cl.[7] ..... H05B 6/68

(52) U.S. Cl. ..... 219/716; 219/702; 363/49; 363/97

(58) Field of Search ..... 219/716, 715, 219/702, 721, 760; 363/21, 49, 97

(56) References Cited

U.S. PATENT DOCUMENTS 4,012,617 A * 3/1977 Burke et al. ..... 219/716
4,873,408 A * 10/1989 Smith et al. ..... 219/716
5,171,949 A * 12/1992 Fujishima et al. ..... 219/721

FOREIGN PATENT DOCUMENTS

JP 1-221884 * 9/1989 ..... 219/716
JP 1-292790 * 11/1989 ..... 219/716
JP 1-313887 * 12/1989 ..... 219/716
JP 4-198627 * 7/1992 ..... 219/716

* cited by examiner

*Primary Examiner*—Philip H. Leung
(74) *Attorney, Agent, or Firm*—Robert E. Bushnell, Esq.

(57) ABSTRACT

Disclosed is a microwave oven, including a power supply part supplying a commercial AC power, a rectifier and filter part rectifying and filtering the commercial AC power, a high voltage transformer generating a high voltage with the DC power from said rectifier and filter part, a magnetron generating electromagnetic waves by the high voltage supplied from said high voltage transformer. The microwave oven further includes a control signal generator part generating a control signal; an inverter part converting the DC power supplied from said rectifier and filter part into an AC power with a high voltage; and a control part determining whether said control signal converted by said high voltage transformer is within a predetermined range, and preventing said control signal from being applied to said magnetron where the control signal is determined to be beyond the predetermined range. With this configuration, abnormal control signal is controlled, thereby being capable of more securely protecting a circuit system of the microwave oven.

22 Claims, 9 Drawing Sheets

MICROWAVE OVEN

CLAIM OF PRIORITY

This application makes reference to, incorporates the same herein, and claims all benefits accruing under 35 U.S.C. §119 from an application for MICROWAVE OVEN earlier filed in the Korean Industrial Property Office on the 27th of Jul. 2000 and there duly assigned Serial No. 43477/2000.

BACKGROUND OF THE INVENTION

1. Field of the Invention

The present invention relates in general to microwave ovens, and more particularly, a microwave oven which is capable of protecting a circuit system thereof by controlling a control signal applied to an inverter part, thereby prolonging durability of the microwave oven.

2. Description of the Related Art

Generally, a microwave oven secures a high voltage from a secondary winding of a core type high voltage transformer by supplying a commercial alternating current (AC) power to a primary winding of the high voltage transformer. The high voltage generated by the high voltage transformer is supplied to a magnetron, and then the magnetron is oscillated to generate electromagnetic waves.

FIG. 9 is a block diagram of a control system of a conventional microwave oven. As illustrated therein, the conventional microwave oven includes a power supply part 51, a high voltage transformer 53 generating a high voltage by means of electric power supplied from the power supply part 51, a magnetron 55 generating electromagnetic waves by means of the high voltage generated by the high voltage transformer 53, a relay switching part 57 switching on- and off- the generation of the high voltage transformer 53, and a control part 59 controlling operations of the high voltage transformer 53, the magnetron 55 and the relay switching part 57, based on the power from the power supply part 51 and an external signal inputted into the controlling part 59.

With this configuration, when the electric power is supplied from the power supply part 51, the control part 59 controls the relay switching part 57 to turn on based on the external signal, thereby supplying the electric power for the primary winding of the high voltage transformer 53. If the electric power is supplied to the primary winding of the high voltage transformer 53, thousands of volts of voltage is generated in the secondary winding of the high voltage transformer 53 so as to oscillate the magnetron 55.

However, since the core of the high voltage transformer 53 used in the conventional microwave oven is made of a silicon steel sheet, it is heavy and bulky, and it is inconvenient for consumers to handle it. Because the number of turns for the secondary winding of the high voltage transformer should increase in order to generate a high voltage from the high voltage transformer 53, this causes a problem that the high voltage transformer 53 must further increase in dimension.

In addition, to adjust an output voltage from the secondary winding of the high voltage transformer, the conventional microwave oven employs a method of controlling a duty cycle, because it is not possible to perform an analog control from a low output to a high output. The duty cycle control method controls the maximum rated output supplied from the power supply part 51 with a ratio of "on" time and "off" time of the high voltage transformer. In the duty cycle control method, if the on-time of the maximum rated output is short and the off-time thereof is long, the low output is generated, whereas the high output is generated if the on-time of the maximum rated output is long and the off-time thereof is short. Where the output is adjusted by the duty cycle control method, there is a great variation in temperature affecting cooking of food, which may lower an efficiency in cooking and further cause the food to be ill-tasting.

SUMMARY OF THE INVENTION

Accordingly, the present invention has been made in view of the above-described shortcomings, and it is an object of the present invention to provide a microwave oven able to facilitate an output control by allowing a high voltage transformer to continuously and variably generate a high voltage output from the secondary winding thereof in an analog form.

Another object of the present invention is to provide a microwave oven having a miniature and lightweight high transformer.

These and other objects of the present invention may be achieved by a provision of a microwave oven, including a power supply part supplying a commercial AC (alternating current) power, a rectifier and filter part rectifying and filtering the commercial AC power, a high voltage transformer generating a high voltage with the DC (direct current) power from said rectifier and filter part, a magnetron generating electromagnetic waves by means of the high voltage supplied from the a high voltage transformer, the microwave oven further including a control signal generator part generating a control signal; an inverter part converting the DC power supplied from the rectifier and filter part into an AC power with a high voltage; and a control part determining whether the control signal converted by the high voltage transformer is within a predetermined range, and preventing the control signal from being applied to the magnetron where the control signal is determined to be beyond the predetermined range.

Preferably, the microwave oven further includes a reference voltage signal input part inputting a reference voltage signal thereinto, wherein the control part includes a comparator part comparing the control signal converted by the high voltage transformer with the reference voltage signal from the reference voltage signal input part.

Preferably, the control part further includes a D/A (digital to analog) converter part converting the control signal generated by the control signal generator part; an output control part controlling and outputting the control signal converted by the D/A converter part; and an oscillator part varying a cycle of the control signal outputted from the output control part and inputting the control signal into the inverter part.

More preferably, the control part further includes an on-off and soft starter part controlling an on-off operation and soft start operation of the oscillator part depending upon the control signal.

Effectively, the control part further includes a low voltage off part outputting a stop signal to the on-off and soft starter part and the D/A converter part if an abnormal power is inputted from the power supply part.

Preferably, the control part applies the control signal to an input terminal of the output control part if the control signal is not beyond a predetermined range.

Effectively, the output control part uses resistance properties between a drain and a source of a field effect transistor (FET).

Preferably, the oscillator part includes a switching part switching the DC power into an AC power, and the switching part includes a pair of switching power elements.

Preferably, the control part applies the control signal to an input terminal of the switching part if the control signal is not beyond a predetermined range.

Desirably, a transistor for changing a value of an external resistance is provided in the input terminal of the switching part.

Effectively, the on-off and soft starter part uses resistance properties between a drain and a source of an FET for the soft start operation.

Effectively, the low voltage off part includes a logic AND circuit element connecting the to a photo coupler in series.

Desirably, the control part divides the control signal and inputs the divided control signal into the D/A converter part and the on-off and soft starter part.

Effectively, the high voltage transformer includes a ferrite core to reduce a high frequency loss.

Preferably, the control part receives the control signal and determines whether the control signal from the control signal generator part is within a predetermined range, and prevents the control signal from being applied to the inverter part if the control signal is determined to be beyond the predetermined range.

Desirably, the control part determines whether the control signal passing through the inverter part is within the predetermined range, and prevents the control signal from being applied to the high voltage transformer if the control signal is determined to be beyond the predetermined range

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Figure 1:
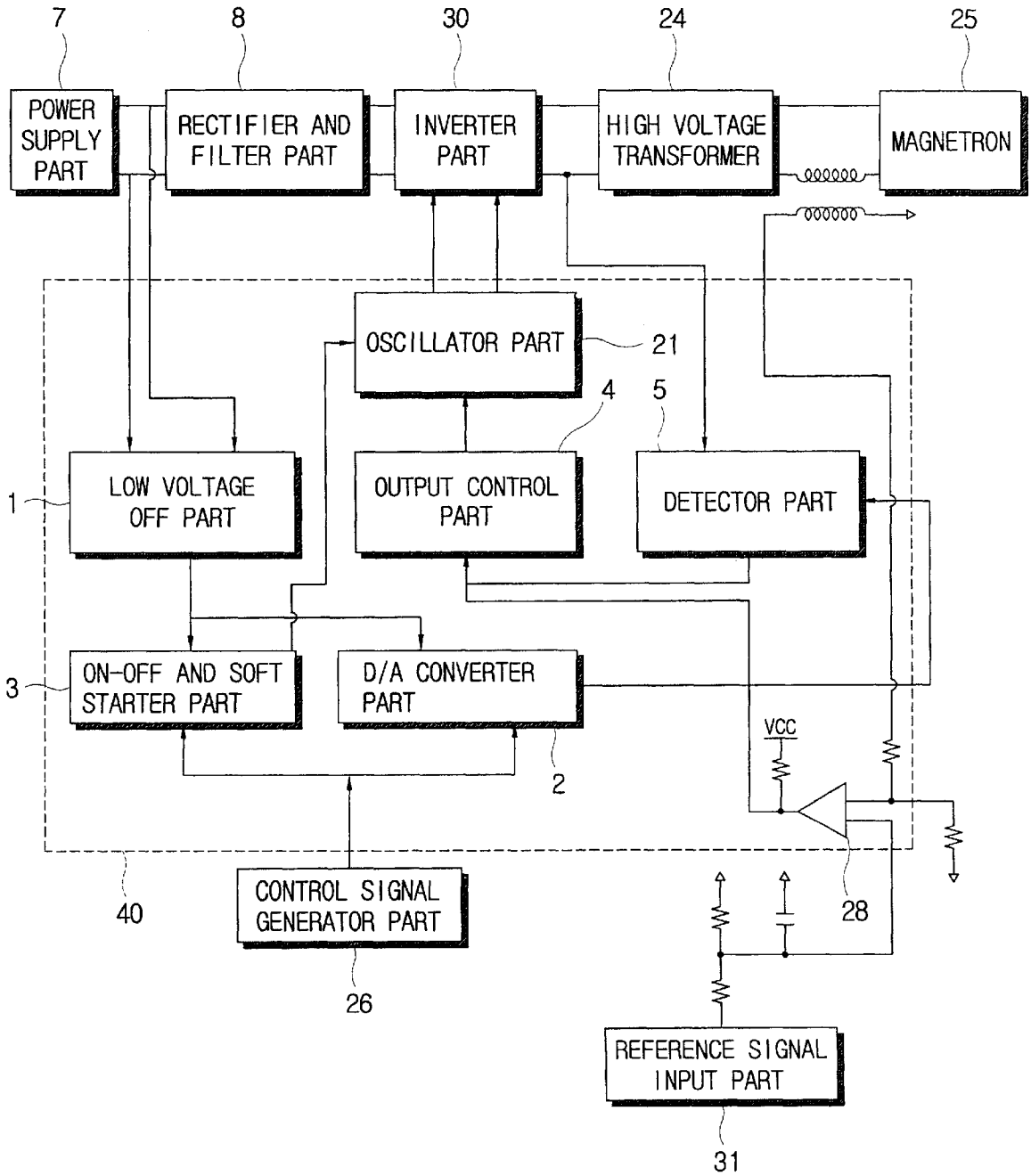
FIG. 1 is a block diagram of a control part of a microwave oven according to a first embodiment of the present invention.
Figure 2:
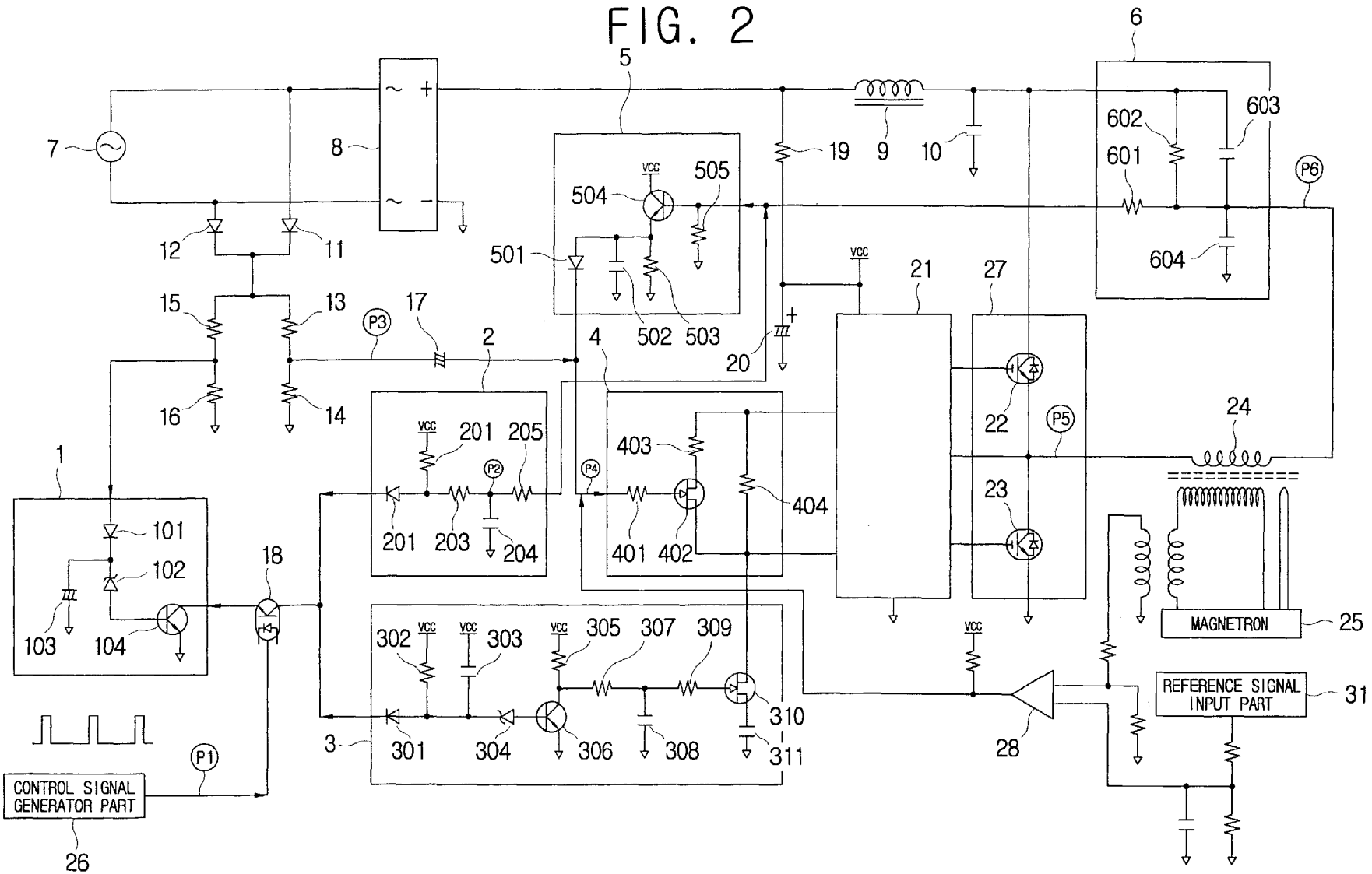
FIG. 2 is a detailed circuit diagram of FIG. 1.

Referring to FIGS. 1 and 2, a microwave oven according to the present invention includes a power supply part 7 supplying a commercial AC power, a control signal generator part 26 generating a control signal, an inverter part 30 converting the commercial AC power into a high frequency AC power based on the control signal, a magnetron 25 generating electromagnetic waves based on the AC power passing through the inverter part 30, a rectifier and filter part 8 rectifying and filtering the power supplied from the power supply part 7, the high voltage transformer 24 generating a high voltage based on the supplied power, a reference voltage signal input part 31 inputting a reference voltage signal to determine whether the control signal inputted to the magnetron 25 is within a predetermined range, and a control part 40 blocking the control signal from being inputted to the magnetron 25 where the control signal inputted from the control signal generator part 26 is beyond the predetermined range. The inverter part 30 is provided with a resonator part 6 (see FIG. 2) connected in series to a first winding of the high voltage transformer 24 to perform a resonance operation.

The control part 40 includes a D/A converter 2 converting the control signal inputted from the control signal generator 26 into an analog signal, a detector part 5 detecting whether the control signal converted by the D/A converter part 2 is abnormal, and an output control part 4 outputting the control signal to the inverter part 30 where the control signal detected by the detector part 5 are not operation.

The control part 40 further includes an oscillator part 21 provided between the output control part 4 and the inverter part 30, varying cycles of the control signal outputted from the output control part 4. The oscillator part 21 is connected to a switching part 27 (see FIG. 2) switching the DC power to the AC power. The switching part 27 has a pair of switching power elements 22 and 23.

The control part 40 further includes an on-off and soft starter part 3 controlling on-off and soft start operations of the oscillator part 21 based on the control signal inputted from the signal generator part 26, and a low voltage off part 21 outputting a stop signal to the on-off and soft starter part 3 and the D/A converter part 2 when the power inputted through the power supply part 7 is determined to be abnormal. The control part 40 further includes a comparator part 28 comparing the control signal inputted into the magnetron 25 via the high-voltage transformer 24 and the reference voltage signal inputted from the signal input part 31.

The rectifier and filter part 8 is connected to a reactor 9 (see FIG. 2) and a capacitor 10 (also see FIG. 2), to prevent noises from the inverter being discharged outside. A resistor 19 and a filter capacitor 20 connected to the rectifier and filter part 8 allows a high DC voltage approximately over 310 V rectified in a rectifying element 8 to be lowered to about 15 V so that the DC voltage approximately over 310 V can be used as a semiconductor driving power.

The control part 40 compares the control signal inputted to the magnetron 25 with the reference voltage signal from the reference voltage signal input part 31 through the comparator part 28. Where it is determined that the control signal is higher than the reference voltage signal, the control part 40 prevents the control signal from returning to the inverter part 30. Where it is determined that the control signal is not beyond the reference voltage signal, the control signal is controlled to be fed back to an input terminal of the output control part 4 toward the inverter 30. In this case, the control signal may be controlled to be fed back to an input or output terminal of the oscillator part 21.

Figure 3:
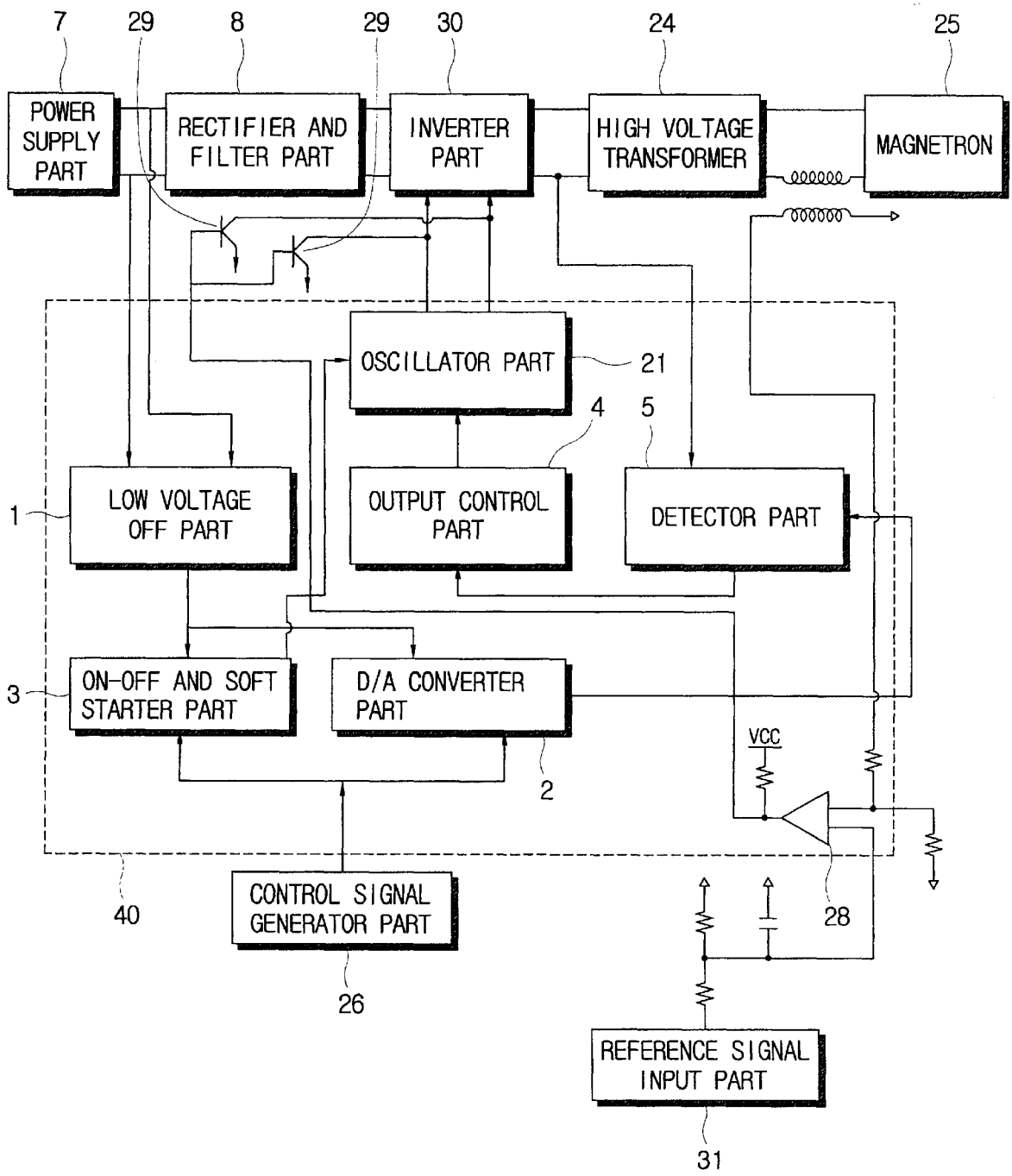
FIG. 3 is a block diagram of a control part of a microwave oven according to a second embodiment of the present invention.
Figure 4:
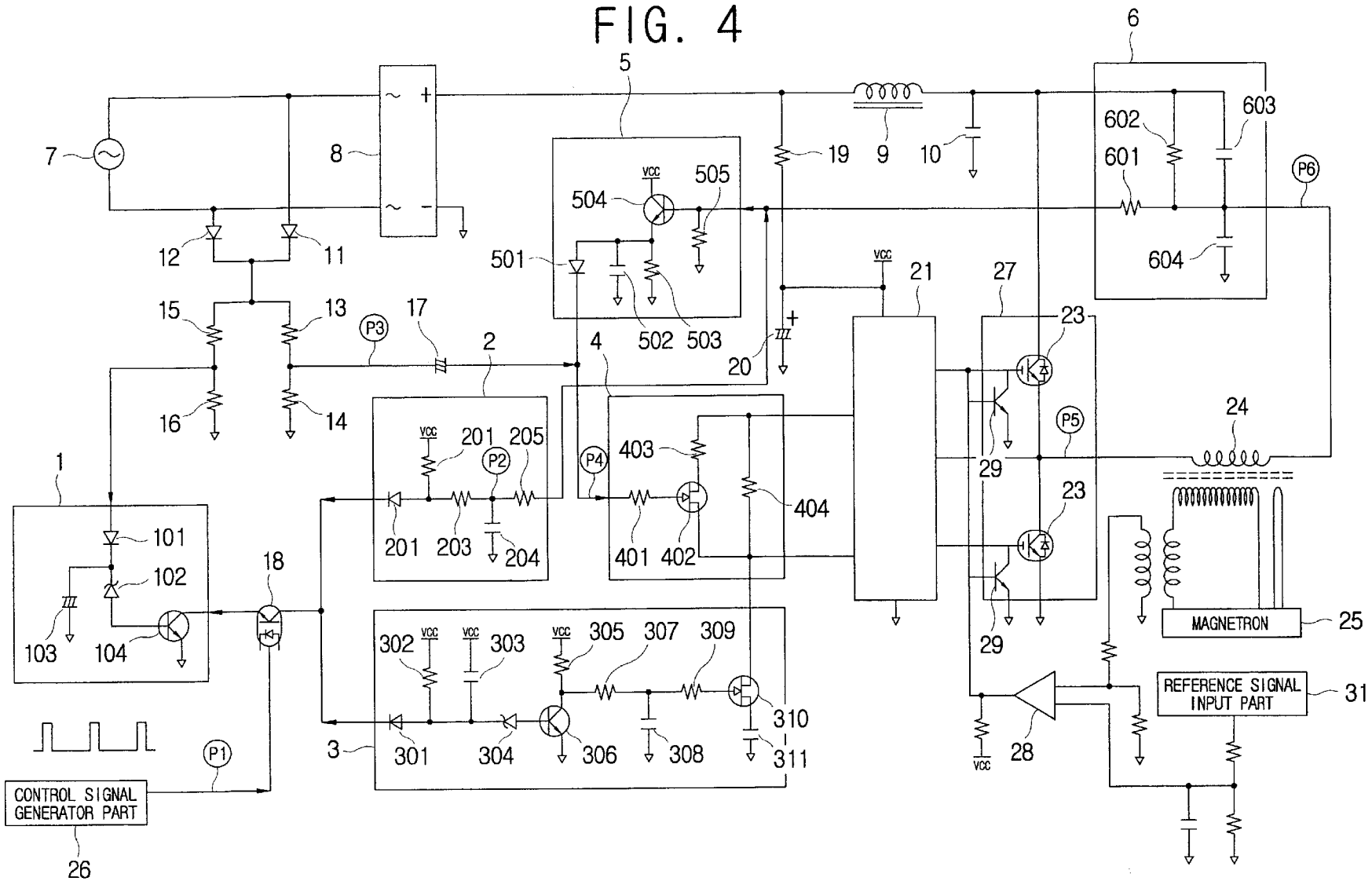
FIG. 4 is a detailed circuit diagram of FIG. 3.
Figure 5:
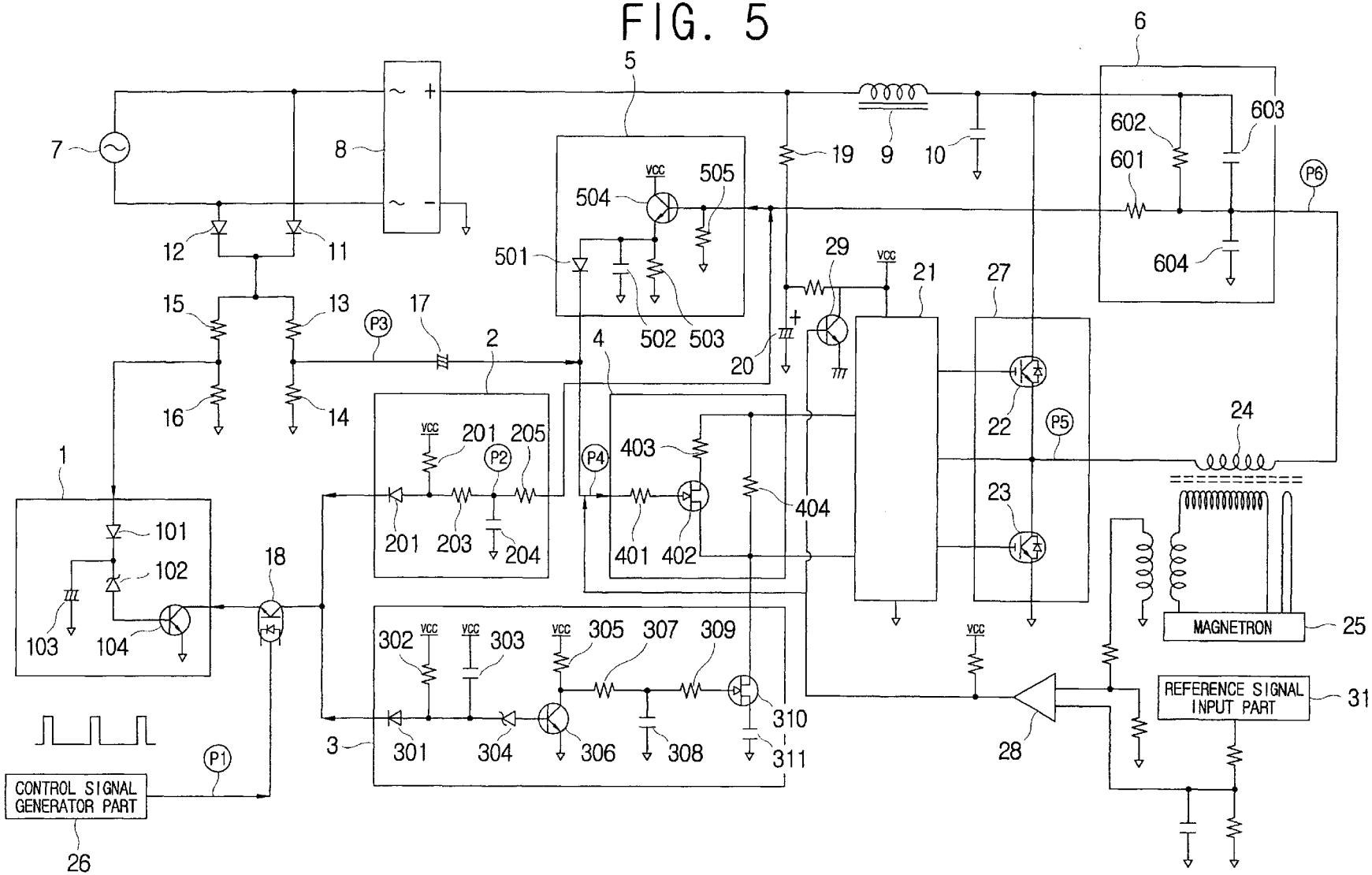
FIG. 5 is a detailed circuit diagram of a microwave oven according to a third embodiment of the present invention.

As in a second embodiment of the present invention which is depicted in FIGS. 3 and 4, a transistor 29 for changing a value of an external resistance may be provided in the output terminal of the oscillator part 21. The transistor 29 prevents the control signal from being inputted to the switching part 27 when the control signal is higher than the reference voltage signal. As in a second embodiment of the present invention which is shown in FIG. 5, the transistor 29 may be provided in the input terminal of the oscillator part 21.

If the control signal passing through the comparator part 28 is inputted into the output control part 4, the signal can be repeatedly inputted along with the control signal from the control signal generator part 26, thereby adjusting the output within shortened driving times.

The high-voltage transformer 24 employed in the microwave oven according to the present invention is driven with a high frequency (about 20 Khz (Kilohertz)) through an oscillation, and therefore, a ferrite core is used, allowing loss of the high frequency to be reduced. The high-voltage transformer 24 of the present invention using the ferrite core decreases about one fourth in volume and about one twentieth in weight, in comparison with the conventional core high-voltage transformer. Since the high-voltage transformer of the present invention is driven with the high frequency by means of oscillation, it does not need to increase the number of turns of the secondary winding thereof.

With this configuration, the control part 40 controls the digital control signal generated by the control signal generator part 26 to be divided, and inputs the divided signals into the D/A converter 2 and the on-off and soft starter part 3 respectively. The flow of the divided control signal inputted to the D/A converter 2 will be described in more detail hereinbelow.

The divided control signal inputted to the D/A converter 2 is converted into an analog signal and inputted to the detector part 5. The control part 40 determines whether the control signal inputted to the detector part 5 is within a predetermined control range. If the control signal is determined to be beyond the predetermined control range, the control part 40 interrupts the control signal from being applied to the output control part 4.

Where the control signal is determined to be within the predetermined control range, the control signal is outputted to the inverter part 30 through the oscillator part 21, and the inverter part 30 converts the commercial DC power supplied from the power supply part 7 into a high frequency AC power. The high frequency AC power is supplied to the magnetron 25 through the primary and secondary windings of the high-voltage transformer 24, so that the magnetron 25 generates electromagnetic waves.

The control signal supplied to the primary winding of the high-voltage transformer 24 from the inverter part 30 is by-passed to the detector part 5. The control part 40 determines again whether the control signal by-passed to the detector part 5 is within the predetermined control range, before it is applied to the high voltage transformer 24. If the control signal is determined to be within the predetermined control range, the control signal is applied to the input terminal of the output control part 4. If the control signal is determined to be beyond the predetermined control range, the control part 40 interrupts the control signal from being applied to the input terminal of the output control part 4, thereby resulting in stabilizing the circuit system.

The control signal applied to the magnetron 25 via the high-voltage transformer 24 is by-passed to the comparator part 28. The comparator part 28 compares the control signal applied thereto and the reference voltage signal inputted from the signal input part 41. Where the control signal applied to the comparator part 28 is not in the predetermined range of the reference voltage signal, the control part 40 interrupts the control signal from being applied to the output control part 4. Where the control signal applied to the comparator part 28 is in the predetermined range of the reference voltage signal, the control signal is inputted to the output control part 4.

Respective elements constituting the control part 40 including the D/A converter part 2, the on-off and soft starter part 3, the oscillator part 21 and the output control part 2 will be described in more detail.

When the power is initially supplied to the microwave oven from the power supply part 7 or when the microwave oven is on standby, the control signal is not inputted to the input terminal of a photo coupler 18 connected to the control signal generator part 26 from the signal generator part 26, and therefore, the inverter part 30 is in no operation. This means that the oscillation from the inverter part 30 does not occur. To allow the inverter part 30 to oscillate, pulse width modulation (PWM) waveforms should be continuously applied through an input terminal (P1) of the photo coupler 18 from the control signal generator part 26.

The PWM waves applied to the photo coupler 18 functions to operate (start oscillation) of the inverter part 30 and to control an output of the inverter part 30 by varying oscillation frequencies of the oscillator part 21 depending upon changes in pulse width of the PWM waveforms.

When the PWM waveforms are not applied to the on-off and soft starter part 3, a transistor 306 constituting the on-off and soft starter part 3 turns on with a base thereof biased by a resistor 302 and a capacitor 303. If the transistor 306 turns on, a gate potential of a field effect transistor (FET) 310 becomes minimum and the resistance between a drain and a source of the FET 310 becomes infinitely great. When the resistance between the drain and the source of the FET becomes infinitely great, a capacitor 311 results in being separated from the oscillator part 21, thereby allowing the oscillation of the oscillator part 21 to stop. Thus, the inverter part 30 stops operating Conversely, where the PWM waveforms are applied to the on-off and soft starter part 3, the base bias of the transistor 306 is drained out through an orientation diode 301, thereby allowing the transistor 306 to turn off. A zener diode 304 interrupts the residue base bias of the transistor 306, allowing the transistor to maintain the state. If the transistor 306 turns off, a filter capacitor 308 is slowly charged with a VCC voltage through the resistor 305 and the gate resistor 307. Accordingly, the resistance between the drain and the source of the FET 310 slowly becomes decreased, and the oscillating capacitor 311 result in being combined with the oscillator part 21, thereby initiating the oscillation.

Where the PWM waveforms are applied to the input terminal of the photo coupler 18, the values of the analog voltage of the D/A converter 2 are determined depending upon the relation between high values and low values in the PWM waveforms.

Where the voltage value (P2) is lowered, the value of resistance between the drain and the source of the FET 402 is increased to allow the oscillating frequencies to be lowered and the output of the inverter part 30 to be increased. A resistor 201 is for a gate bias voltage of the FET 402; and the resistors 203 and 205 and a capacitor 204 are π-type filters, converting digital PWM waveforms into analog waveforms, which are applied to the FET 310 through a gate resistor 401.

As described above, the element coupling and separating the oscillator part 21 and the oscillating capacitor 311 is the resistor between the drain and the source of the FET 310.

Where the resistor between the drain and the source is high, the capacitor 311 results in having a lower capacity, thereby increasing the oscillating frequencies. Conversely, where the resistor between the drain and the source is so low as to be ignored, the oscillation occurs for the whole capacity of the capacitor 311.

Where the oscillating frequency is high, the output of the inverter part 30 becomes decreased. Thus, when the inverter part 30 starts to oscillate, it is desirable to increase the oscillating frequency as high as possible to allow the output to be the minimum, and then to slowly lower the frequency until the desired output is obtained, thereby giving no burden to the various electric elements. The soft start operation considers all the properties of the oscillating frequency and the inverter part 30. The present invention realizes the soft start by means of the resistance property between the drain and the source of the FET 310.

Hereinbelow, the output control part of the present invention will be described in more detail.

The oscillator part 21 oscillates by itself, when and external resistor (RT) and a capacitor (CT) are connected structurally, generating gate pulses of the switching elements 22 and 23.

The oscillating frequency Fo of the oscillator part 21 is obtained by the equation of Fo=¼(1.4*(RT+75)*CT), wherein the external resistance(RT)=resistance(404)/{resistance(403)+the resistance(402) between the drain and the source and the capacitor(CT)=capacitor(311).

The oscillating frequency can vary by changing the value of external resistance(RT). The inverter part according to the present invention uses the resistance properties between the drain and the source of the FET 402 to change the external resistance value.

The variation of the oscillating frequency aims at improving a power factor of the inverter part 30, in addition to controlling the output of the inverter part 30. Where an output is made from the inverter part 30 considering no improvement of the power factor, the voltage of the secondary winding of the high-voltage transformer 24 is determined in proportion to the voltage supplied through the power supply part. The supplied voltage has a waveform resulting from rectification of the commercial AC power, the secondary high voltage has also the same waveform as the rectified waveform. Consequently, the magnetron 25 is operated in proximity to top points (90° and 270° of the commercial AC signal) of the secondary high voltage. In reverse, the operation of the magnetron 25 stops in proximity to zero crossing points (0° and 180° of the commercial AC signal) because the secondary high voltages is low, which shortens the durability of the oscillating element of the magnetron and deteriorates the efficiency of electric energy. Therefore, it is preferable to provide the oscillating element of the magnetron with a load property similar to that of the possible resistance over the whole range of the commercial AC power waveforms.

Figure 6:
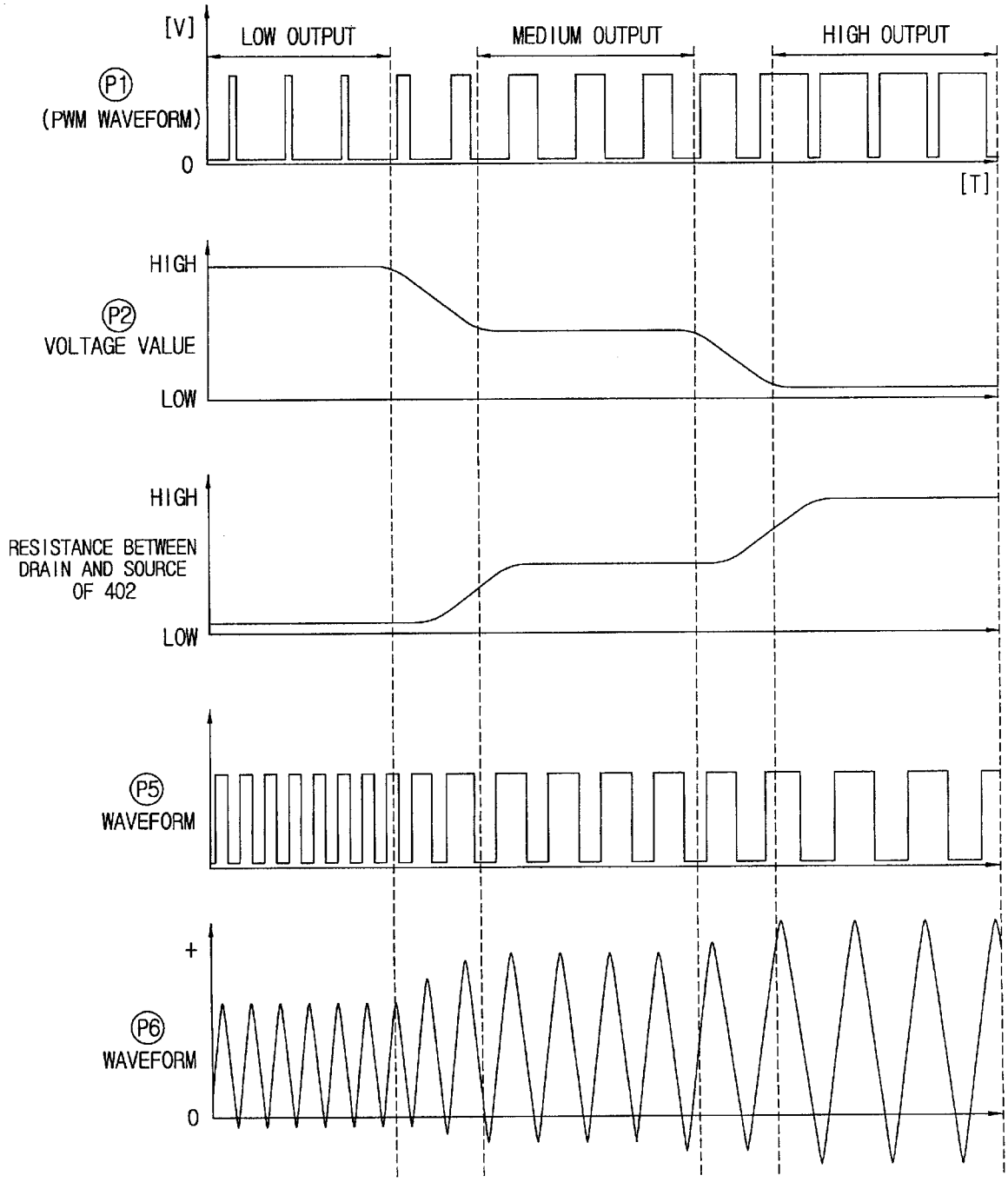
FIG. 6 shows graphs for electric potentials and waveforms of several points in FIG. 2.

As shown in FIG. 6 which shows graphs for an electric potentials and waveforms of several points of FIG. 2, the improvement of the power factor is to allow the magnetron 25 to have a uniform load over the whole section of the AC signal. However, it is not easy for the magnetron 25 to have a uniform load over the whole section of the DC signal under the non-linear load structure, which is merely possible in pure resistance load. Thus, to operate the magnetron 26 to have the uniform load properties, the operational voltage should be calibrated reversely.

The reverse calibration of the operational voltage is accomplished by lowering the high voltage supplied to the magnetron, in proximity to 90° and 270°, at which the magnetron is the most actively operated, and enhancing the high voltage in proximity to 0° and 180°, at which the magnetron is the least actively operated. Hence, electric current approximate to the pure resistance load may be obtained.

Figure 7:
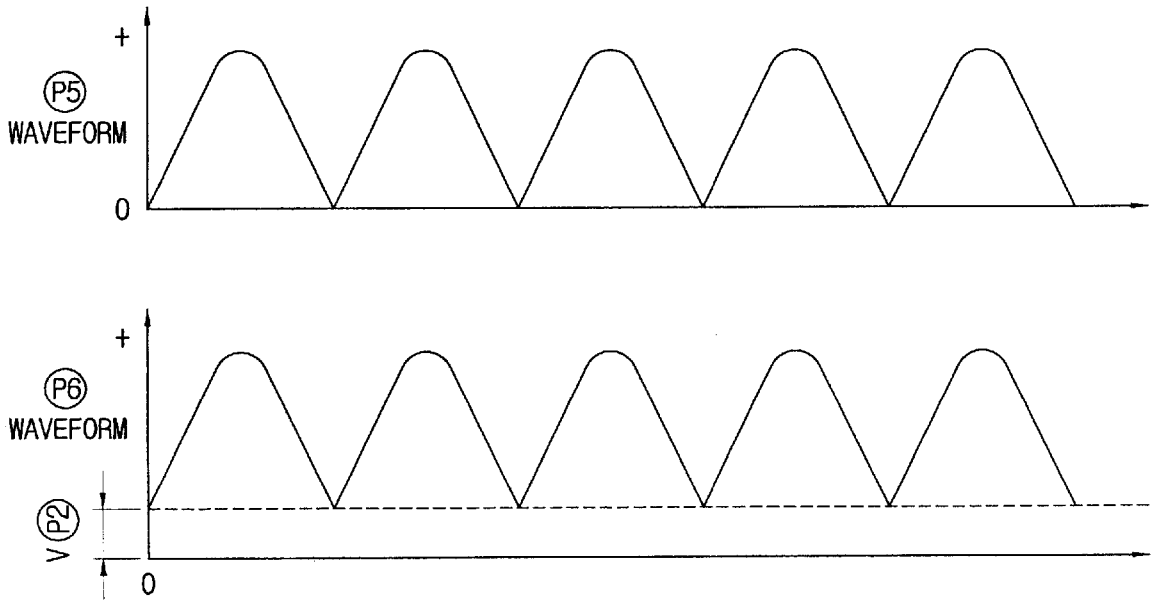
FIG. 7 shows graphs for waveforms of source signals for improving a power factor with DC being overlapped.

Diodes 11 and 12 are full wave rectifier circuit elements to obtain an AC signal waveform necessary for improving the power factor and operating the low voltage off part 1. The obtained waveform signal is converted into low voltage by attenuator resistance elements 13 and 14 and transmitted into the gate of the output control part 4 through the capacitor 17. The capacitor 17 can transmit only the AC signal without lowering gate bias voltage of the output control part 4, thereby allowing the FET 402 to be always in the operable range.

Where the phase angles are 90° and 270°, the strength of the gate bias voltage(P4) is obtained by weighing a sign wave over the reference bias voltage(P2), so that the resistance value between the drain and the source of the FET 402 is changed, allowing the output of the inverter part 30 to vary. That is, where the phase angles are 90° and 270°, the resistance value between the drain and the source of FET 402 becomes the least and the oscillating frequency of the oscillator unit 21 becomes the maximum accordingly, thereby lowering the output of the inverter part. FIG. 7 shows graphs for waveforms of source signals for improving the power factor with DC being overlapped. As described above, the reference source for improving the power factor is obtained from the commercial AC power; and to improve the power factor, the variation in resistance between the drain and the source of the FET is used.

The low voltage off part 1 is used so as to protect the various power elements by suspending the operation of the inverter part 30, where the AC input voltage is extremely low because of abnormal power lines or falling of a thunderbolt. The filter capacitor 103 is charged with the AC signal converted into low voltages by the attenuation resistors 15 and 16 through the diode 101 of the low voltage off part 1. When the AC signal charging the filter capacitor 103 are lower than the predetermined value of the zener diode 102, the transistor 104 is off, to erase the PWM waveforms applied to the photo coupler 18 and suspend the oscillation of the inverter part 30. The photo coupler 18 and the transistor 104 of the low voltage off part 1 are connected in series to each other, and thus these elements are in the form of logic product, that is, AND, so that the resultant turns off if either of them turns off.

Where a resonance voltage generated in the resonance part 6 is higher than a predetermined value, the detector part 5 applies the resonance voltage to the base of the transistor 504 through divided voltage resistors 601 and 505. After an emitter resistor 503 and a charging capacitor 502 are charged with the resonance voltage applied to the transistor 504, the resonance voltage is applied to the input terminal of the output control part 4 through the diode 501.

The resonance voltage of the resonance part 6 is abnormally risen because it is affected by surge noises entering over the power line. To protect the circuits from the surge noises, according to the present invention, the abnormal resonance voltage is converted into normal voltage by means of a transistor employing an emitter-floor mechanism, and the converted normal voltage is fed back to the input terminal of the output control part 4, thereby allowing the resonance part to operate in a closed-loop.

Figure 8:
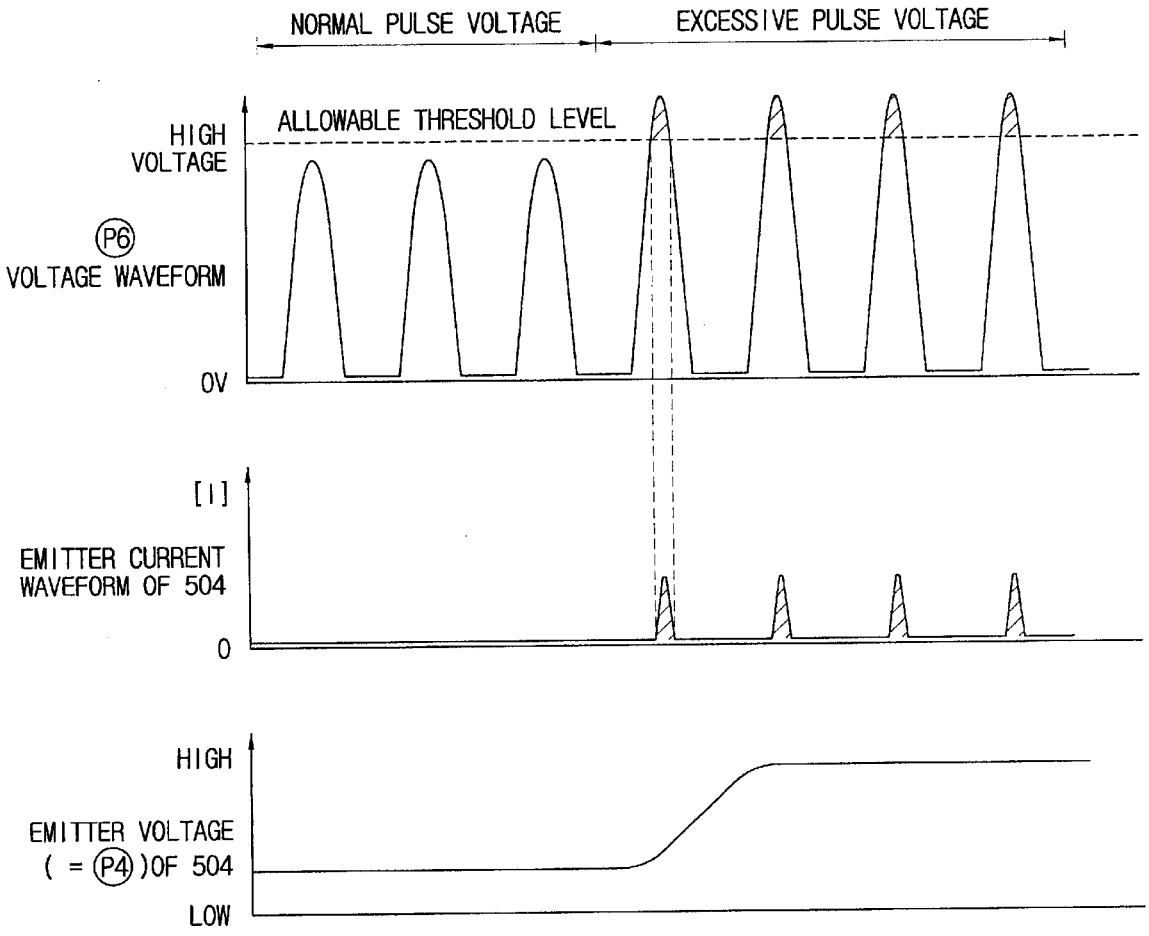
FIG. 8 is a graph showing operational characteristics of a detector part.
Figure 9:
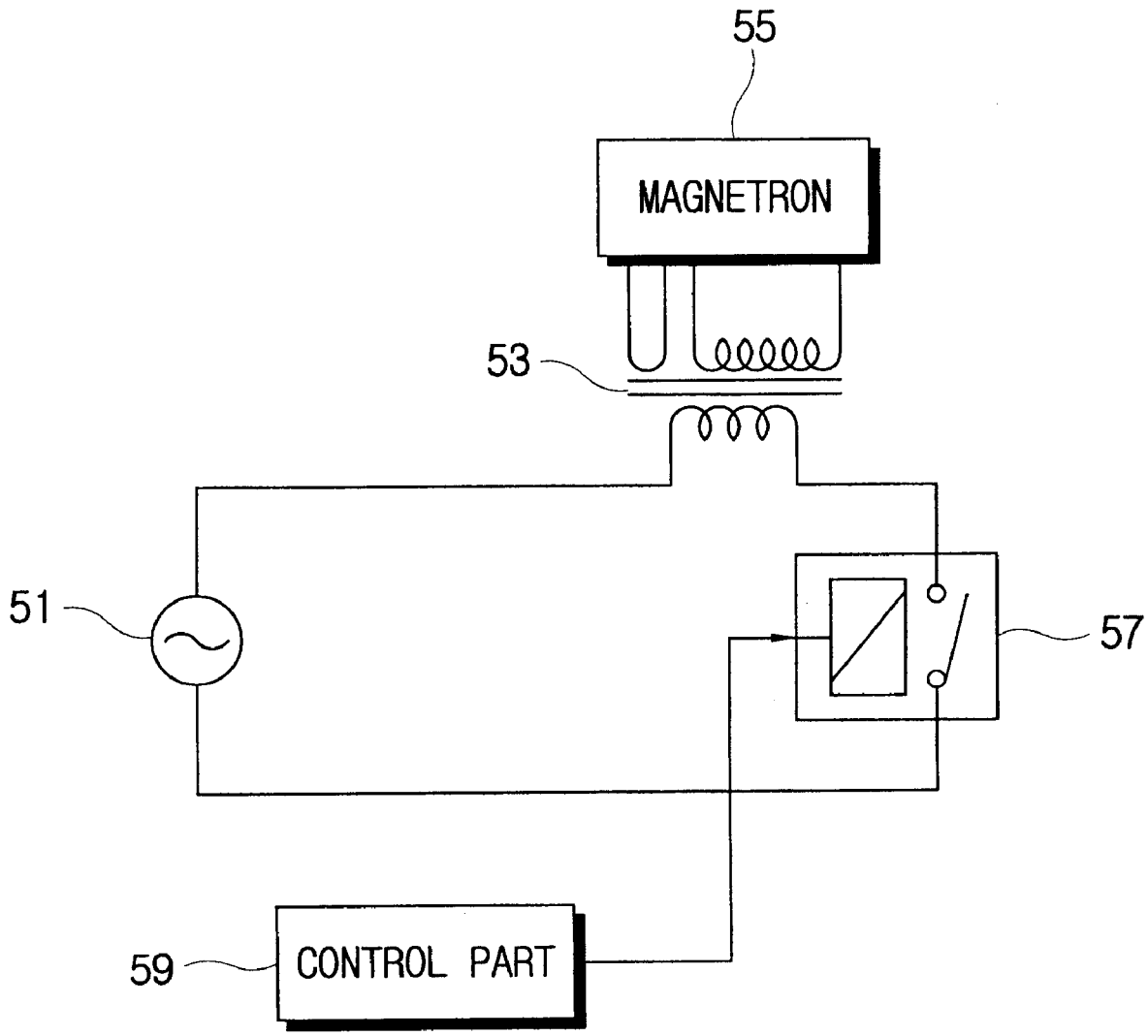
FIG. 9 (PRIOR ART)
FIG. 9 is a block diagram of a control part according to a conventional microwave oven.

As shown in FIG. 8 which is a graph showing operational characteristics of a detector part, before the inverter part 30 starts to operate, that is, when the central voltage (P6) of the resonance part 6 is V/2 during suspension of the inverter part 30, the optimum soft start is realized. Here, "V" means the DC voltage applied to a collector of the switching power element 22 and a resonance capacitor 602 through a reactor 9. Where the commercial AC power supply is 220 V, V is about 310 V, and thus, V/2 is about 155 V.

To adapt the voltage (P6) to the level of V/2, a value of a pull-up resistor 502 should be equal to a sum of a value of the resistor 601 and the resistor 505. However, the value of the resistor 505 is so small as to be ignorable, in comparison with the resistor 601, the resistor 502 have the same value as that of the resistor 601, thereby allowing the DC bias of V/2 level to be supplied the central point (P6) of the resonance part 6.

The main feature of the inverter for the microwave oven according to the present invention is to generate a high voltage through an oscillation of semiconductor, and further, to enhance or lower the strength of the high voltage obtained from the semiconductor oscillation by varying the oscillating frequencies. If the oscillating frequencies are lowered, the resonance current is increased, thereby increasing the high voltage. Conversely, if the oscillating frequencies are heightened, the secondary high voltage is lowered.

The output of the microwave oven, that is, of the magnetron, is proportional to the strength of the secondary high voltage of the high voltage transformer, and therefore, the output of the microwave oven is controlled by controlling the secondary high voltage.

As stated above, the microwave oven according to the present invention enables precision control and output control by feeding back a control signal to the microwave oven. By detecting an abnormal status of the control signal, the circuit system is protected, thereby enhancing the stability thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, comprising a power supply part supplying a commercial alternating current power, a rectifier and filter part rectifying and filtering the commercial alternating current power, a high voltage transformer generating a high voltage with the direct current power from said rectifier and filter part, a magnetron generating electromagnetic waves by means of the high voltage supplied from said high voltage transformer, the microwave oven further comprising:

a control signal generator part generating a control signal;

an inverter part converting the direct current power supplied from said rectifier and filter part into an alternating current power with a high voltage;

said high voltage transformer converting said control signal; and a control part determining whether said control signal converted by said high voltage transformer is within a predetermined range, and preventing said control signal from being applied to said magnetron where the control signal is determined to be beyond the predetermined range.

2. The microwave oven according to claim 1, further comprising:

a reference voltage signal input part inputting a reference voltage signal thereinto;

wherein the control part comprises a comparator part comparing said control signal converted by said high voltage transformer with said reference voltage signal from said reference voltage signal input part.

3. The microwave oven according to claim 1, wherein the control part further comprises:

a digital to analog converter part converting the control signal generated by said control signal generator part;

an output control part controlling and outputting said control signal converted by the digital to analog converter part; and an oscillator part varying a cycle of the control signal outputted from said output control part and inputting the control signal into said inverter part.

4. The microwave oven according to claim 1, wherein said high voltage transformer is comprised of a ferrite core to reduce a high frequency loss.

5. The microwave oven according to claim 1, wherein said control part receives said control signal and determines whether the control signal from the control signal generator part is within a predetermined range, and prevents the control signal from being applied to said inverter part if the control signal is determined to be beyond the predetermined range.

6. The microwave oven according to claim 5, wherein said control part determines whether the control signal passing through said inverter part is within the predetermined range, and prevents the control signal from being applied to said high voltage transformer if the control signal is determined to be beyond the predetermined range.

7. A microwave oven, comprising a power supply part supplying a commercial alternating current power, a rectifier and filter part rectifying and filtering the commercial alternating current power, a high voltage transformer generating a high voltage with the direct current power from said rectifier and filter part, a magnetron generating electromagnetic waves by means of the high voltage supplied from said high voltage transformer, the microwave oven further comprising:

a control signal generator part generating a control signal;

an inverter part converting the direct current power supplied from said rectifier and filter part into an alternating current power with a high voltage;

said high voltage transformer converting said control signal;

a control part determining whether said control signal converted by said high voltage transformer is within a predetermined range, and preventing said control signal from being applied to said magnetron where the control signal is determined to be beyond the predetermined range;

a reference voltage signal input part inputting a reference voltage signal thereinto, wherein the control part comprises a comparator part comparing said control signal converted by said high voltage transformer with said reference voltage signal from said reference voltage signal input part;

a digital to analog converter part converting the control signal generated by said control signal generator part;

an output control part controlling and outputting said control signal converted by the digital to analog converter part; and an oscillator part varying a cycle of the control signal outputted from said output control part and inputting the control signal into said inverter part.

8. A microwave oven, comprising a power supply part supplying a commercial alternating current power, a rectifier and filter part rectifying and filtering the commercial alternating current power, a high voltage transformer generating a high voltage with the direct current power from said rectifier and filter part, a magnetron generating electromagnetic waves by means of the high voltage supplied from said high voltage transformer, the microwave oven further comprising:

a control signal generator part generating a control signal;

an inverter part converting the direct current power supplied from said rectifier and filter part into an alternating current power with a high voltage;

said high voltage transformer converting said control signal;

a control part determining whether said control signal converted by said high voltage transformer is within a predetermined range, and preventing said control signal from being applied to said magnetron where the control signal is determined to be beyond the predetermined range, wherein the control part further comprises:

a digital to analog converter part converting the control signal generated by said control signal generator part;

an output control part controlling and outputting said control signal converted by the digital to analog converter part; and an oscillator part varying a cycle of the control signal outputted from said output control part and inputting the control signal into said inverter part;

a reference voltage signal input part inputting a reference voltage signal thereinto, wherein the control part comprises a comparator part comparing said control signal converted by said high voltage transformer with said reference voltage signal from said reference voltage signal input part; and an on-off and soft starter part controlling an on-off operation and soft start operation of said oscillator part depending upon the control signal.

9. The microwave oven according to claim 8, wherein the control part further comprises a low voltage off part outputting a stop signal to said on-off and soft starter part and said digital to analog converter part if an abnormal power is inputted from said power supply part.

10. The microwave oven according to claim 9, wherein said low voltage off part is comprised of a logic AND circuit element connecting the transistor to a photo coupler in series.

11. The microwave oven according to claim 8, wherein said on-off and soft starter part uses resistance properties between a drain and a source of field effect transistor for the soft start operation.

12. The microwave oven according to claim 8, wherein the control part divides the control signal and inputs the divided control signal into said digital to analog converter part and said on-off and soft starter part.

13. A microwave oven, comprising a power supply part supplying a commercial alternating current power, a rectifier and filter part rectifying and filtering the commercial alternating current power, a high voltage transformer generating a high voltage with the direct current power from said rectifier and filter part, a magnetron generating electromagnetic waves by means of the high voltage supplied from said high voltage transformer, the microwave oven further comprising:

a control signal generator part generating a control signal;

an inverter part converting the direct current power supplied from said rectifier and filter part into an alternating current power with a high voltage;

said high voltage transformer converting said control signal;

a control part determining whether said control signal converted by said high voltage transformer is within a predetermined range, and preventing said control signal from being applied to said magnetron where the control signal is determined to be beyond the predetermined range, wherein the control part further comprises:

a digital to analog converter part converting the control signal generated by said control signal generator part;

an output control part controlling and outputting said control signal converted by the digital to analog converter part; and an oscillator part varying a cycle of the control signal outputted from said output control part and inputting the control signal into said inverter part; and a reference voltage signal input part inputting a reference voltage signal thereinto, wherein the control part comprises a comparator part comparing said control signal converted by said high voltage transformer with said reference voltage signal from said reference voltage signal input part;

wherein the control part applies said control signal to an input terminal of said output control part if the said control signal is not beyond a predetermined range.

14. The microwave oven according to claim 13, wherein said output control part uses resistance properties between a drain and a source of a field effect transistor.

15. A microwave oven, comprising a power supply part supplying a commercial alternating current power, a rectifier and filter part rectifying and filtering the commercial alternating current power, a high voltage transformer generating a high voltage with the direct current power from said rectifier and filter part, a magnetron generating electromagnetic waves by means of the high voltage supplied from said high voltage transformer, the microwave oven further comprising:

a control signal generator part generating a control signal;

an inverter part converting the direct current power supplied from said rectifier and filter part into an alternating current power with a high voltage;

said high voltage transformer converting said control signal;

a control part determining whether said control signal converted by said high voltage transformer is within a predetermined range, and preventing said control signal from being applied to said magnetron where the control signal is determined to be beyond the predetermined range, wherein the control part further comprises:

a digital to analog converter part converting the control signal generated by said control signal generator part;

an output control part controlling and outputting said control signal converted by the digital to analog converter part; and an oscillator part varying a cycle of the control signal outputted from said output control part and inputting the control signal into said inverter part; and a reference voltage signal input part inputting a reference voltage signal thereinto, wherein the control part comprises a comparator part comparing said control signal converted by said high voltage transformer with said reference voltage signal from said reference voltage signal input part;

wherein the oscillator part comprises a switching part switching said direct current power into an alternating current power.

16. The microwave oven according to claim 15, wherein the switching part is comprised of a pair of switching power elements.

17. The microwave oven according to claim 16, wherein the control part applies the control signal to an input terminal of said switching part if the control signal is not beyond a predetermined range.

18. The microwave oven according to claim 17, wherein a transistor for changing a value of an external resistance is provided in the input terminal of said switching part.

19. The microwave oven according to claim 15, further comprising a unit changing a value of an external resistance in the output terminal of said oscillator part.

20. The microwave oven according to claim 15, further comprising a unit preventing said control signal from being inputted to said switching part when the control signal is higher than a reference voltage signal.

21. A method of a microwave oven, comprising the steps of:

generating a control signal;

converting the direct current power supplied from a rectifier and a filter part into an alternating current power with a high voltage;

converting said control signal by a high voltage transformer;

determining whether said control signal converted by said high voltage transformer is within a predetermined range, and preventing said control signal from being applied to a magnetron where the control signal is determined to be beyond the predetermined range;

inputting a reference voltage signal;

comparing said control signal converted by said high voltage transformer with said reference voltage signal;

converting said control signal by a digital to analog converter part;

controlling and outputting said control signal converted by said digital to analog converter part by an output control part; and varying a cycle of the control signal outputted from said output control part and inputting the control signal into said inverter part by an oscillator part.

22. The method of claim 21, further comprising the step of preventing said control signal from being inputted to a switching part of said oscillator part when the control signal is higher than a reference voltage signal.

* * * * *